US012729413B2

(12) United States Patent
Herry et al.

(10) Patent No.: US 12,729,413 B2
(45) Date of Patent: Sep. 8, 2026

(54) METHOD FOR PRODUCING A STEEL SHEET HAVING EXCELLENT PROCESSABILITY BEFORE HOT FORMING

(71) Applicant: ArcelorMittal, Luxembourg (LU)

(72) Inventors: Deborah Herry, Luppy (FR); Fabrice Germain, Hayange (FR); Clément Philippot, Ennery (FR); Sandra Le Guillard, Mars la Tour (FR)

(73) Assignee: ArcelorMittal, Luxembourg (LU)

( * ) Notice: Subject to any disclaimer, the term of this patent is extended or adjusted under 35 U.S.C. 154(b) by 0 days.

(21) Appl. No.: 18/706,476

(22) PCT Filed: Nov. 2, 2022

(86) PCT No.: PCT/IB2022/060556

§ 371 (c)(1),
(2) Date: May 1, 2024

(87) PCT Pub. No.: WO2023/079454

PCT Pub. Date: May 11, 2023

(65) Prior Publication Data

US 2025/0011892 A1 Jan. 9, 2025

(30) Foreign Application Priority Data

Nov. 5, 2021 (WO) ..... PCT/IB2021/060246

(51) Int. Cl.

| | |
|---|---|
| ***C21D 9/46*** | (2006.01) |
| ***B21D 22/02*** | (2006.01) |
| ***C21D 1/18*** | (2006.01) |
| ***C21D 6/00*** | (2006.01) |
| ***C21D 8/02*** | (2006.01) |
| ***C21D 8/0221*** | (2026.01) |
| ***C21D 8/0247*** | (2026.01) |
| ***C21D 8/0278*** | (2026.01) |
| ***C22C 38/00*** | (2006.01) |
| ***C22C 38/02*** | (2006.01) |
| ***C22C 38/04*** | (2006.01) |

(Continued)

(52) U.S. Cl.

CPC ..... *C21D 9/46* (2013.01); *B21D 22/022* (2013.01); *C21D 1/18* (2013.01); *C21D 6/002* (2013.01); *C21D 6/004* (2013.01); *C21D 6/005* (2013.01); *C21D 6/008* (2013.01); *C21D 8/0205* (2013.01); *C21D 8/0226* (2013.01); *C21D 8/0236* (2013.01); *C21D 8/0263* (2013.01); *C21D 8/0278* (2013.01); *C22C 38/001* (2013.01); *C22C 38/002* (2013.01); *C22C 38/02* (2013.01); *C22C 38/04* (2013.01); *C22C 38/06* (2013.01); *C22C 38/22* (2013.01); *C22C 38/26* (2013.01); *C22C 38/28* (2013.01); *C22C 38/32* (2013.01); *C22C 38/38* (2013.01); *C22C 38/44* (2013.01); *C22C 38/48* (2013.01); *C22C 38/50* (2013.01); *C22C 38/54* (2013.01); *C22C 38/58* (2013.01); *C21D 2211/002* (2013.01); *C21D 2211/005* (2013.01); *C21D 2211/008* (2013.01)

(58) Field of Classification Search

CPC . C21D 9/46; C21D 1/18; C21D 6/002; C21D 6/004; C21D 6/005; C21D 6/008; C21D 8/0205; C21D 8/0226; C21D 8/0236; C21D 8/0263; C21D 8/0278; C21D 2211/002; C21D 2211/005; C21D 2211/008; C21D 2211/003; C21D 1/02; C21D 8/005; C21D 8/021; C21D 8/0273; C21D 9/0068; C21D 1/673; B21D 22/022; C22C 38/001; C22C 38/002; C22C 38/02; C22C 38/04; C22C 38/06; C22C 38/22; C22C 38/26; C22C 38/28; C22C 38/32; C22C 38/38; C22C 38/44; C22C 38/48; C22C 38/50; C22C 38/54; C22C 38/58; B32B 15/011; B32B 15/012; B32B 15/013; C23C 2/06; C23C 2/12

See application file for complete search history.

(56) References Cited

U.S. PATENT DOCUMENTS

| | | | |
|---|---|---|---|
| 10,570,470 | B2 | 2/2020 | Tamaki et al. |
| 2014/0144560 | A1 | 5/2014 | Yamano et al. |

(Continued)

FOREIGN PATENT DOCUMENTS

| | | | |
|---|---|---|---|
| EP | 2631307 | A1 | 8/2013 |
| EP | 2687620 | A1 | 1/2014 |

(Continued)

OTHER PUBLICATIONS

Search Report of PCT/IB2022/060556 of Jan. 16, 2022 and International Report on Patentability.

(Continued)

*Primary Examiner* — Adil A. Siddiqui

(74) *Attorney, Agent, or Firm* — Davidson Kappel LLC

(57) ABSTRACT

Steel sheet suitable for a multistep hot stamping process and associated manufacturing process, the steel sheet having a composition including, by weight percent: C: 0.13-0.4%, Mn: 0.4-4.2%, Si: 0.1-2.5%, Cr≤2%, Mo≤0.65%, Nb≤0.1%, Al≤3.0%, Ti≤0.1%, B≤0.005%, P≤0.025%, S≤0.01%, N≤0.01%, Ni≤2.0%, Ca≤0.1%, W≤0.30%, V≤0.1%, Cu≤0.2%, wherein Q is less than 20, the factor Q being defined as (the elements are expressed in weight percent): Q=114−68*C−18*Mn+20*Si−56*Cr−61*Ni−37*Al+39*Mo+79*Nb−17691*B, the steel sheet having a microstructure including, in surface fraction, from 60% to 100% of recrystallized ferrite, less than 40% of the sum of martensite, bainite and carbides and less than 5% of non-recrystallized ferrite.

4 Claims, No Drawings

(51) Int. Cl.

| | |
|---|---|
| ***C22C 38/06*** | (2006.01) |
| ***C22C 38/22*** | (2006.01) |
| ***C22C 38/26*** | (2006.01) |
| ***C22C 38/28*** | (2006.01) |
| ***C22C 38/32*** | (2006.01) |
| ***C22C 38/38*** | (2006.01) |
| ***C22C 38/44*** | (2006.01) |
| ***C22C 38/48*** | (2006.01) |
| ***C22C 38/50*** | (2006.01) |
| ***C22C 38/54*** | (2006.01) |
| ***C22C 38/58*** | (2006.01) |

(56) References Cited

U.S. PATENT DOCUMENTS

| | | | |
|---|---|---|---|
| 2014/0370329 | A1 | 12/2014 | Nonaka et al. |
| 2017/0145531 | A1 | 5/2017 | Hayashi et al. |
| 2020/0071799 | A1 | 3/2020 | Takeda et al. |

FOREIGN PATENT DOCUMENTS

| | | | |
|---|---|---|---|
| EP | 2946848 | A1 | 11/2015 |
| EP | 3561142 | A1 | 10/2019 |
| JP | 2006265583 | A | 10/2006 |
| KR | 2014-0025588 | | 3/2014 |
| KR | 2019-0096380 | | 8/2019 |
| WO | WO2012053636 | A1 | 4/2012 |
| WO | WO2020080493 | A1 | 4/2020 |

OTHER PUBLICATIONS

Naoya Masahashi:"Basic Manufacturing Course: Rediscovering the appeals of metals Observation and Analysis, Part 1, Structure Observation (49th Technical Seminar);" Mar. 29, 2017 Mar. 29, 2017 at Creation Core Higashi-osaka.

Naoya Masahashi:"Basic Manufacturing Course: Rediscovering the appeals of metals Observation and Analysis, Part 2, Composition Analysis, Structure Observation (50th Technical Seminar);" Jul. 25, 2017 at Creation Core Higashi-osaka.

Third Party Observations submitted in corresponding JP application No. 2024-526615A, (publication JP2024543823A).

Third Party Observations dated Apr. 28, 2026 filed in corresponding Korean Application KR 10-2024-7017244, (published as KR2024/0096576A).

METHOD FOR PRODUCING A STEEL SHEET HAVING EXCELLENT PROCESSABILITY BEFORE HOT FORMING

The present invention relates to steel sheets and to high strength press hardened steel parts having excellent processability before hot forming.

BACKGROUND

Multistep processing of steel sheets to make complex parts using hot forming is becoming increasingly popular. By adding to the number of operations that can be performed on the steel sheets, multistep processes allow hot stampers to make parts having more complex geometries compared to conventional one step hot stamping. It also allows to reduce the number of post-processing operations on the parts. This in turns allows to better address the challenges faced by the automotive industry of improved vehicle safety and environmental performance while keeping high industrial productivity rates and low manufacturing costs.

SUMMARY OF THE INVENTION

Compared to standard one step hot stamping, the amount of processing time is longer in multistep hot stamping. As a consequence, the very rapid cooling rates obtained in one step hot stamping cannot be reached in multistep processes. Thus, specific steel compositions need to be used, which allow for the steels to be quenched and reach the desired very high mechanical properties even with the relatively lower cooling rates of multistep processing. For example, it is interesting to use steel composition that can be transformed into an austenitic, or ferrite+austenite structure, and quenched into martensitic microstructures even with a cooling rate below 20° C./s, preferably even with a cooling rate below 16° C./s.

However, such steel compositions present the technical disadvantage that they can easily be quenched during the production of the steel coil itself, for example on the metallic coating line in the case of coated steels, or on the continuous annealing line in the case of bare steels. Indeed, the steel compositions of steels suitable for multistep processing allows them to be hardened even at the relatively low cooling rates which are practiced after the annealing furnace on these lines.

This is an issue for processing the steel before hot stamping. Indeed, the steel will be too hard to be easily wound in the form of a coil on the line where annealing is performed and then to be cut, without excessive maintenance of the cutting tools, into steel blanks before hot stamping, or to be preformed before hot stamping, such as is the case in the indirect hot stamping processes.

It is a purpose of the current invention to address this issue by providing a steel sheet having a chemical composition and a microstructure that makes it suitable for its use in a multistep hot stamping process while being sufficiently soft for good processability before hot stamping.

A further purpose of the current invention is to provide a manufacturing process for said steel sheet.

A steel sheet refers to a flat sheet of steel having a top and a bottom face, which are also referred to as a top and bottom side or as a top and bottom surface. The distance between said faces is designated as the thickness of the sheet. The thickness can be measured for example using a micrometer, the spindle and anvil of which are placed on the top and bottom faces. In a similar way, the thickness can also be measured on a formed part.

A blank refers to a flat sheet, which has been cut from a steel sheet to any shape suitable for its use.

In the following description, claims and examples, the term steel sheet generally refers to the material before further processing operations, such as cutting into blanks and before hot stamping. On the other hand, the term blank refers to the material which has been cut out from a steel sheet to be used in the hot stamping process.

Hot stamping is a forming technology for steel which involves heating a blank of steel, or a preformed part made from a blank of steel, up to a temperature at which the microstructure of the steel has at least partially transformed to austenite, forming the blank or preformed part at high temperature by stamping it and simultaneously quenching the formed part to obtain a microstructure having a very high strength, possibly with an additional partitioning or tempering step in the heat treatment.

A multistep hot stamping process is a particular type of hot stamping process including at least one stamping step and consisting of at least two process steps performed at high temperature, above 300° C. For example, a multistep process can involve a first stamping operation and a subsequent hot trimming operation, so that the finished part, at the exit of the hot stamping process, does not need to be further trimmed. For example, a multistep process can involve several successive stamping steps in order to manufacture parts having more complex shapes then what can be realized using a single stamping operation. For example, the parts are automatically transferred from one operation to another in a multistep process, for example using a transfer press. For example, the parts stay in the same tool, which is a multipurpose tool that can perform the different operations, such as a first stamping and a subsequent in-tool trimming operation.

Hot stamping allows to obtain very high strength parts with complex shapes and presents many technical advantages. Multistep hot stamping allows to obtain even more complex shapes than one step hot stamping.

Hardness is a measure of the resistance to localized plastic deformation induced by mechanical indentation. It is well correlated to the mechanical properties of a material and is a useful local measurement method which does not require to cut out a sample for tensile testing. In the current invention, the hardness measurements are made using a Vickers indenter according to standard ISO 6507-1. The Vickers hardness is expressed using the unit Hv.

DETAILED DESCRIPTION

In the description, examples and claims, the term annealing, annealing furnace, annealing process, all refer to the metallurgical process whereby a cold rolled steel sheet is recrystallized by heating it. In the case of steels having other phases than ferrite, annealing is performed at a temperature at least above Ac1 (temperature at which the microstructure starts to transform to austenite).

The term cooling speed refers to the speed at which the steel sheet is cooled during the annealing process, while it is being manufactured. The soaking temperature refers to the maximum temperature reached by the steel sheet in the annealing furnace. The cooling speed, expressed in ° C./s, is the average speed at which the steel sheet is cooled down between the soaking temperature and 300° C. The cooling speed can be expressed using the following formula:

Cooling speed=(annealing temperature−300° C.)/(time spent by the steel sheet between the exit of the annealing furnace and reaching 300° C.).

The terms austenitizing and quenching refer to the hot stamping process of a steel blank.

The term quenching speed, or quenching rate, refers to the average speed, expressed in ° C./s, at which the steel blank is cooled down to 300° C. during the hot stamping process. The austenitizing temperature refers to the maximum temperature reached by the steel blank in the austenitizing furnace before hot stamping. The quenching speed can be expressed using the following formula:

Quenching speed=(austenitizing temperature−300° C.)/(time spent by the steel blank between the exit of the austenitizing furnace and reaching 300° C.).

The composition of the steel according to the invention will now be described, the content being expressed in weight percent. The chemical compositions are given in terms of a lower and upper limit of the composition range, said limits being themselves included within the possible composition range according to the invention.

According to the invention the carbon ranges from 0.13% to 0.4% to ensure a satisfactory strength. Above 0.4% of carbon, weldability and bendability of the steel sheet may be reduced. If the carbon content is lower than 0.13%, the tensile strength after hot stamping will not reach the targeted value.

The manganese content ranges from 0.4% to 4.2%. Above 4.2% of addition, the risk of central segregation increases to the detriment of processability and the risk of crack formation during hot stamping and subsequent use of the part will be increased. Below 0.4% the hardenability of the steel sheet is reduced and the required strength after hot stamping will not be reached.

The silicon content ranges from 0.1% to 2.5%. Silicon is an element participating in the hardening in solid solution. Silicon is added to limit carbides formation. Above 2.5%, silicon oxides form at the surface, which impairs the coatability of the steel. Moreover, the weldability of the steel sheet may be reduced.

The chromium content does not exceed 2%. Chromium is an element participating in the hardening in solid solution. The chromium content is limited to below 2% to limit processability issues and cost.

Molybdenum content does not exceed 0.65%. Molybdenum improves the hardenability of the steel. Molybdenum is not higher than 0.65% to limit costs.

Niobium content is limited to 0.1%. Niobium improves ductility of the steel. Above 0.1% the risk of formation of coarse NbC or Nb(C,N) precipitates increases to the detriment of processability. Preferably the niobium content ranges from 0.02% to 0.06%.

According to the invention, the aluminum is limited to 3.0%. Aluminum is a very effective element for deoxidizing the steel in the liquid phase during elaboration. Aluminium can protect boron if titanium content is not sufficient. The aluminium content is lower than 3.0% to avoid oxidation problems and ferrite formation during press hardening.

According to the invention, the titanium is limited to 0.1%. Titanium can protect boron, which can be trapped within BN precipitates. Titanium content is limited to 0.1% to avoid excess TiN formation.

According to the invention, the boron content is limited to 0.005%. Boron improves the hardenability of the steel. The boron content is not higher than 0.005% to avoid slab breaking issues during continuous casting.

Phosphorous is controlled to below 0.025%, because it leads to fragility and weldability issues.

Sulphur is controlled to below 0.01% because the presence of Sulphur in the liquid steel can lead to the formation of MnS precipitates which are detrimental to bendability.

Nitrogen is controlled to below 0.01%. The presence of Nitrogen can lead to the formation of precipitates such as TiN or TiNbCN, which are detrimental to the processability of the steel.

Nickel is optionally added, up to a level of 2.0%. Nickel can be used to protect the steel from delayed cracking. The Nickel content is limited to limit the costs.

Calcium may also be added as an optional element up to 0.1%. Addition of Ca at the liquid stage makes it possible to create fine oxides which promote castability of continuous casting.

Tungsten may also be added as an optional element up to 0.3%. In these quantities, Tungsten increases the quenchability and the hardenability thanks to the formation of carbides.

Vanadium may also be added up to 0.1%. Vanadium improves ductility of the steel. Above 0.1% the risk of formation of coarse precipitates increases to the detriment of processability.

Copper is limited to 0.2%. Cu acts to strengthen the steel by solid solution strengthening. Above 0.2% there is a risk of hot shortness during the hot rolling process.

The remainder of the composition of the steel is iron and unavoidable impurities resulting from the smelting process and depending on the process route. In the case of a production route using a blast furnace, the level of unavoidable impurities is very low. In the case of a production route using an Electric Arc Furnace loaded with scraps, the steel sheet can further comprise residual elements coming from such scraps such as Antimony, Arsenic and Lead, up to 0.03% and Tin up to 0.05%, which are considered as unavoidable impurities.

In a particular embodiment, the steel sheet chemical composition is (in weight percent)

C: 0.15-0.25%
Mn: 0.5-1.8%
Si: 0.1-1.25%
Cr: 0.1-1.0%
Al: 0.01-0.1%
Ti: 0.01-0.1%
B: 0.001-0.004%
P≤0.020%
S≤0.010%
N≤0.010% and comprising optionally one or more of the following elements, by weight percent:
Mo≤0.40%
Nb≤0.08%
Ca≤0.1% the remainder of the composition being iron and unavoidable impurities resulting from the smelting.

In a particular embodiment, the steel sheet chemical composition is (in weight percent)

C: 0.26-0.40%
Mn: 0.5-1.8%
Si: 0.1-1.25%
Cr: 0.1-1.0%
Al: 0.01-0.1%
Ti: 0.01-0.1%
B: 0.001-0.004%
P≤0.020%
S≤0.010%
N≤0.010% and comprising optionally one or more of the following elements, by weight percent:

Ni≤0.5%
Mo≤0.40%
Nb≤0.08%
Ca≤0.1% the remainder of the composition being iron and unavoidable impurities resulting from the smelting, In a particular embodiment, the steel sheet chemical composition is (in weight percent)

C: 0.3-0.4%
Mn: 0.5-1.0%
Si: 0.4-0.8%
Cr: 0.1-0.4%
Mo: 0.1-0.5%
Nb: 0.01-0.1%
Al: 0.01-0.1%
Ti: 0.008-0.03%
B: 0.0005-0.003%
P≤0.020%
S≤0.004%
N≤0.005%
Ca≤0.001%

And comprising optionally:

Ni<0.5% the remainder of the composition being iron and unavoidable impurities resulting from the smelting, In a particular embodiment, the steel sheet chemical composition is (in weight percent)

C: 0.24-0.38%
Mn: 0.40-3%
Si: 0.10-0.70%
Cr: 0-2%
Al: 0.015-0.070%
Nb≤0.060%
Ti: 0.015-0.10%
N: 0.003-0.010%
S: 0.0001-0.005%
P: 0.0001-0.025%
Ni: 0.25-2%

And wherein:

Ti/N>3.42, $$2.6\ C + \frac{Mn}{5.3} + \frac{Cr}{13} + \frac{Si}{15} \geq 1.1\%$$

And comprising optionally:

Mo: 0.05-0.65%
Ca: 0.0005-0.005%
W: 0.001-0.30% the remainder of the composition being iron and unavoidable impurities resulting from the smelting, In a particular embodiment, the steel sheet composition comprises the following elements expressed in weight %:

C: 0.2-0.34%
Mn: 0.50-2.20%
Si: 0.5-2%
Cr≤0.8%
P≤0.020%
S≤0.010%
N≤0.010% and comprising optionally one or more of the following elements, by weight percent:

Al: ≤50.2%
B≤0.005%
Ti≤0.06%
Nb≤0.06% the remainder of the composition being iron and unavoidable impurities resulting from the smelting.

In a particular embodiment, the steel sheet composition comprises the following elements expressed in weight %:

C: 0.15-0.4%
Mn: 1-3.5%
Si: 1.0-1.65%
Cr≤2%
Al≤0.5%
Ti≤0.1%
B≤0.005% the remainder of the composition being iron and unavoidable impurities resulting from the smelting.

In a particular embodiment, the steel sheet composition comprises the following elements expressed in weight %:

C: 0.15%-0.25%
Mn: 1.5%-2.5%
Si: 0.1%-0.4%
Cr≤0.5%
Al: 0.03%-1%
Ti: 0.02%-0.1%
B: 0.0015%-0.0050%
P≤0.012% the remainder of the composition being iron and unavoidable impurities resulting from the smelting.

In a particular embodiment, the steel sheet composition comprises the following elements expressed in weight %:

C: 0.1-0.3%
Mn: 3-4.2%
Si: 0.7-2%
Al: 0.1-1%
Mo: 0.1-0.5%
Nb: 0.01-0.05%
Ti: 0.01-0.05%
B: 0.001-0.005% the remainder of the composition being iron and unavoidable impurities resulting from the smelting.

In order to be suitable for use in a multistep hot stamping process, the chemical composition of the steel sheet according to the invention further satisfies the following formula (the elements are expressed in weight %):

$$Q < 20$$

Wherein $$Q = 114 - 68 * C - 18 * Mn + 20 * Si - 56 * Cr - 61 * Ni - 37 * Al + 39 * Mo + 79 * Nb - 17691 * B$$

This formula was established using dilatometric experiments on samples having different steel compositions. The samples were heated in a furnace to a temperature of 900° C. and held at that temperature for 2 minutes. The samples were then quenched using different quenching speeds. Metallographic investigations were performed on the quenched samples to determine their microstructure. The critical quenching speed for a given sample was defined as being the quenching speed above which the quenched samples had a fully martensitic microstructure. A linear regression was then established between the chemical composition of the samples and the critical quenching speed determined through the above described protocol. Factor Q was determined through this linear regression and corresponds to a very good approximation of the critical quenching speeds for low carbon steels.

The inventors have found that when Q<20, the steel can withstand the relatively low cooling speeds of a multistep hot stamping process.

Preferably, the steel even has a lower factor Q, with Q≤16.

The steel sheet according to the invention has the following microstructure (expressed in surface fraction):

at least 60% of ferrite less than 40% of the sum of bainite+martensite+carbides less than 5% of non-recrystallized ferrite Ferrite is a soft phase. The presence of at least 60% of ferrite in the steel sheet ensures that the steel sheet is sufficiently soft for processing.

By limiting the amount of bainite, martensite and carbides in the microstructure, the inventors have found that the steel sheet has sufficiently low hardness in order to be successfully processed in the cold state before hot stamping.

By limiting the amount of non-recrystallized ferrite, the inventors have found that the steel sheet has sufficiently low hardness in order to be successfully processed in the cold state before hot stamping.

For example, the steel sheet according to the invention has a hardness below 270 Hv. This corresponds approximately to a tensile strength above 800 MPa. Above this strength level, mechanical processing such as cutting, becomes increasingly difficult and calls for difficult and costly maintenance operations of the cutting tools.

In a particular embodiment, the steel sheet according to the invention has a high hardenability after hot stamping and quenching.

The hardenability is characterised by the hardness increase of the steel blank obtained from the steel sheet after hot stamping. It can be measured by submitting the steel sheet to a hot stamping operation and measuring the hardness before and after.

The high quenching speed hardenability ΔHvhi of the steel sheet is defined as ΔHvhi=Hvfast−Hvini, wherein Hvfast is the hardness of the steel sheet after heating it to a temperature of 900° C. for 7 minutes and quenching it at a speed of 100° C./s, and Hvini is the hardness of the steel sheet before heat treatment.

For example, the high quenching speed hardenability ΔHvhi of the steel sheet is at least 200 Hv.

The low quenching speed hardenability ΔHvlo of the steel sheet is defined as ΔHvlo=Hvslow−Hvini, wherein Hvslow is the hardness of the steel sheet after heating it to a temperature of 900° C. for 7 minutes and quenching it at a speed of 20° C./s, and Hvini is the hardness of the steel sheet before heat treatment.

Thanks to the fact that the steel sheet according to the invention can be quenched at low quenching speeds and still have a very high hardness after hot stamping, the low quenching speed hardenability ΔHvlo of the steel sheet according to the invention remains high. For examples ΔHvlo is at least 150 Hv, more preferably at least 180 Hv, even more preferably at least 200 Hv.

Another way of expressing the fact that the steel sheet according to the invention can be quenched at low quenching speeds and still have a very high hardness after hot stamping is by considering the difference Hvfast−Hvslow, which is the same as the difference ΔHvhi−ΔHvlo. The difference Hvfast−Hvslow of the steel sheet according to the invention is low, because the material still reaches a very high hardness after low quenching speed hot stamping. For example, the difference Hvfast−Hvslow is less than 100 Hv, preferably less than 50 Hv, even more preferably less than 40 Hv.

The steel sheet according to the invention is manufactured according to the following process route:

A steel slab having a composition described above is cast and reheated to a temperature $T_{reheat}$ comprised from 1100° C. to 1300° C. before being hot rolled at a finishing hot rolling temperature comprised between 800° C. and 950° C. to obtain a hot rolled steel sheet.

The hot-rolled steel is then cooled and coiled at a temperature $T_{coil}$ lower than 670° C. and optionally pickled to remove oxidation.

The coiled steel sheet is then cold rolled to obtain a cold rolled steel sheet. The cold-rolling reduction ratio ranges from 20% to 80%, preferably from 35% to 80%. Below 20%, the recrystallization during subsequent heat-treatment is not favored, which may impair the ductility of the steel sheet. Above 80%, there is a risk of edge cracking during cold-rolling.

The cold rolled steel sheet is then subjected to an annealing process, optionally followed by a metallic coating process. For example, the steel sheet is coated with an aluminum based metallic coating. For example, the steel sheet is coated with a Zinc based metallic coating.

For example, the steel sheet is coated with an aluminum based metallic coating, comprising by weight 7% to 15% silicon, 2% to 4% iron and optionally between 15 ppm and 30 ppm calcium, the remainder being aluminum and inevitable impurities resulting from elaboration.

For example, the steel sheet is coated with an aluminum based metallic coating, comprising from 2.0 to 24.0% by weight of zinc, from 1.1 to 12.0% by weight of silicon, optionally from 0 to 8.0% by weight of magnesium, and optionally additional elements chosen from Pb, Ni, Zr, or Hf, the content by weight of each additional element being inferior to 0.3% by weight, the balance being aluminum and unavoidable impurities.

The annealing process is led in such a way that the K factor, which will be further defined hereafter, stays below 0.50.

The K factor is defined by the following formula, according to the steel composition of the sheet (all elements are expressed in weight %):

If the steel composition is such that Mn−Si≥1.5%:

$$K = \frac{Tsoaking - Ae1}{Ae3 - Ae1} * \frac{\ln(trex)}{5} * (1 + 0.1 * \ln(\text{heating rate})) - \left(\frac{Mn}{0.6} - \frac{Si}{1.2}\right) * 0.03$$

If the steel composition is such that Mn−Si≤1.5%:

$$K = \frac{Tsoaking - Ae1}{Ae3 - Ae1} * \frac{\ln(trex)}{5} * (1 + 0.1 * \ln(\text{heating rate}))$$

Wherein:

Tsoaking is the soaking temperature expressed in ° C., i.e. the maximum temperature reached by the steel sheet during the annealing process trex is the recrystallisation time expressed in seconds, which is defined as being the time spent above 700° C. during the annealing process heating rate is the average speed at which the steel sheet reaches the soaking temperature expressed in ° C./s, i.e.

Heating rate=(*T*soaking−30)/(time spent between 30° C. and *T* soaking)

Ae1 and Ae3 are respectively the temperatures, expressed in ° C., at which austenite starts to form under equilibrium conditions and at which the steel becomes fully austenitic under equilibrium conditions. For the purpose of determining the K factor without having to perform physical measurements of Ae1 and Ae3, the inventors have devised formulas for Ae1 and Ae3 based on the chemical composition of the steel sheet. These formulas are based on known correlations and additional measurements performed by the inventors and is particularly suitable for the steel compositions of the current invention.

$$Ae1 = 734 + 77*C - 29*Mn + 14*Si + 7*Cr - 38*Ni - 22*Al - 25*Mo + 123*Nb - 8621*B$$

$$Ae3 = 935 - 257*C - 25*Mn + 32*Si - 17*Cr - 83*Ni\ 17*Al + 129*Mo + 156*Nb - 19473*B$$

Through numerous experiments and numerical correlations, the inventors have found that the steel sheet manufactured using the above described processing route has sufficiently low hardness in order to be easily processed in the cold state, before the hot stamping operation. In particular, it is important to respect the above described K<0.50 when annealing the cold rolled steel sheet to reach sufficiently low hardness. The final product, after annealing and optionally coating the steel sheet, has a hardness below 270 Hv.

Furthermore, the inventors have found that when applying the invention, the steel sheet hardness is surprisingly mostly independent from the cooling rate after the annealing step. That is to say, even though the steel sheet has a chemical composition which ensures that it will have a low critical quenching speed after being fully austenitized before hot stamping it (thanks to Q<20 or even preferentially Q≤16), surprisingly so, the material does not reach very high hardness levels even when cooled at relatively high speed on the line where it is annealed after cold rolling.

This behavior of the steel sheet on the annealing line is very beneficial from an industrial point of view because it means that the steel sheet will have sufficiently low hardness regardless of the thermal path it follows after annealing. This brings robustness to the product properties and allows for more flexibility after annealing. In particular, it means that no specific adaptations need to be done to the layout of existing manufacturing lines after annealing to accommodate for multistep steels. It also allows to apply any type of metallic coating, the application of which has an influence on the thermal path, in particular when performing hot dip coating, without having to worry about the hardness of the final product.

The press part manufacturing process and ensuing pressed part characteristics will now be detailed.

A steel blank is cut out of the steel sheet according to the invention and heated in an austenitizing furnace to a temperature above Ac1. Preferably, the steel blank is heated to a temperature comprised from 880° C. to 950° C. during 10 seconds to 15 minutes to obtain a heated steel blank. The heated blank is then transferred to a forming press before being hot formed. For example, the hot forming process is a multistep process. For example, the hot forming process has a quenching speed which is lower than 20° C./s and greater than or equal to 3° C./s, preferably greater than or equal to 5° C./s.

The microstructure of the hot stamped part comprises in surface fraction, more than 95% of martensite and less than 5% of bainite+ferrite. For example, the hot stamped part has a hardness above 400 Hv, even more preferably above 440 Hv.

The invention will be now illustrated by the following examples, which are by no way limitative.

In all tables, the values and references of samples that are outside of the invention are underlined.

TABLE 1

| | chemical compositions | | | | | | | | | | | | | | | |
|---|---|---|---|---|---|---|---|---|---|---|---|---|---|---|---|---|
| Steel composition reference | % C | % Mn | % S | % P | % Si | % Cr | % Ni | % Al | % Mo | % Nb | % Ti | % B | % N | Ae1 | Ae3 | Q |
| A | 0.191 | 1.990 | 0.001 | 0.010 | 0.197 | 0.202 | 0.000 | 0.041 | 0.000 | 0.000 | 0.024 | 0.0025 | 0.003 | 672 | 792 | 12 |
| B | 0.177 | 1.020 | 0.001 | 0.012 | 0.690 | 0.820 | 0.000 | 0.022 | 0.190 | 0.031 | 0.026 | 0.0029 | 0.005 | 707 | 846 | 9 |
| C | 0.219 | 1.960 | 0.001 | 0.011 | 1.150 | 0.674 | 0.000 | 0.039 | 0.000 | 0.000 | 0.024 | 0.0024 | 0.004 | 693 | 810 | 5 |
| D | 0.192 | 3.920 | 0.001 | 0.013 | 1.280 | 0.025 | 0.021 | 0.350 | 0.195 | 0.023 | 0.029 | 0.0027 | 0.005 | 618 | 810 | 2 |
| E | 0.340 | 0.600 | 0.002 | 0.013 | 0.550 | 0.300 | 0.400 | 0.040 | 0.200 | 0.050 | 0.020 | 0.0025 | 0.005 | 716 | 798 | 16 |
| F | 0.235 | 1.220 | 0.002 | 0.011 | 0.210 | 0.200 | 0.000 | 0.039 | 0.000 | 0.000 | 0.022 | 0.0023 | 0.006 | 700 | 804 | 27 |

Table 1 lists the 6 different chemical compositions that were tested, alongside with the associated Q factor, Ae1 and Ae3, all computed using the above described formulas.

A, B, C, D and E are all within the range of the invention, whereas F is outside of the range because the calculation of the Q factor for F gives a result of 27. It should be noted that steel composition F corresponds to a typical composition of 22MnB5 steel for hot stamping.

As will be subsequently detailed, this difference in Q factor between steels A-E and steel F means that samples made using steels A-E can be hot stamped and simultaneously quenched at low quenching speeds to still yield more than 95% martensitic microstructures, whereas steel F will not have a 95% martensitic microstructure if the quenching speed is too low.

TABLE 2

| hot rolling and cold rolling process parameters | | | | |
|---|---|---|---|---|
| Steel composition reference | Slab reheating temperature (° C.) | Finishing Rolling temperature (° C.) | Coiling temperature (° C.) | reduction ratio at the cold rolling stage |
| A | 1200 | 870 | 570 | 61% |
| B | 1150 | 850 | 550 | 53% |
| C | 1150 | 850 | 550 | 52% |
| D | 1230 | 920 | 450 | 68% |

TABLE 2-continued

| hot rolling and cold rolling process parameters | | | | |
|---|---|---|---|---|
| Steel composition reference | Slab reheating temperature (° C.) | Finishing Rolling temperature (° C.) | Coiling temperature (° C.) | reduction ratio at the cold rolling stage |
| E | 1200 | 895 | 530 | 67% |
| F | 1200 | 895 | 550 | 56% |

Table 2 lists the production parameters of the hot rolling and cold rolling process which are also all within the range of the invention. The same set of parameters was used for each chemical composition.

TABLE 3

| annealing process parameters | | | | | | | |
|---|---|---|---|---|---|---|---|
| Sample Reference | Steel composition | heating rate (° C./s) | Soaking T (° C.) | Soaking time (sec) | recrystal-lisation time trex (sec) | K | Cooling rate (° C./s) |
| I1 | A | 3 | 720 | 90 | 97 | 0.31 | 100 |
| I2 | A | 30 | 720 | 90 | 91 | 0.39 | 100 |
| R1 | A | 3 | 750 | 90 | 107 | 0.58 | 100 |
| R2 | A | 30 | 750 | 30 | 32 | 0.51 | 100 |
| I3 | A | 10 | 720 | 90 | 92 | 0.35 | 12 |
| I4 | B | 3 | 750 | 90 | 107 | 0.32 | 100 |
| I5 | B | 30 | 750 | 90 | 92 | 0.37 | 100 |
| R3 | B | 3 | 780 | 90 | 117 | 0.55 | 100 |
| R4 | B | 30 | 780 | 90 | 93 | 0.64 | 100 |
| R5 | B | 10 | 780 | 90 | 98 | 0.59 | 8 |
| I6 | C | 30 | 720 | 90 | 91 | 0.28 | 100 |
| I7 | C | 3 | 750 | 30 | 47 | 0.42 | 100 |
| R6 | C | 30 | 750 | 90 | 92 | 0.59 | 100 |
| R7 | C | 3 | 780 | 30 | 57 | 0.67 | 100 |
| I8 | C | 10 | 720 | 90 | 92 | 0.26 | 4 |
| I9 | D | 3 | 720 | 30 | 37 | 0.26 | 100 |
| I10 | D | 3 | 720 | 90 | 97 | 0.38 | 100 |
| R8 | D | 3 | 750 | 90 | 107 | 0.55 | 100 |
| R9 | D | 3 | 780 | 30 | 57 | 0.59 | 100 |
| I11 | D | 10 | 720 | 90 | 92 | 0.43 | 12 |
| I12 | E | 3 | 720 | 90 | 97 | 0.05 | 100 |
| I13 | E | 30 | 720 | 90 | 91 | 0.06 | 100 |
| R10 | E | 3 | 780 | 30 | 57 | 0.70 | 100 |
| R11 | E | 30 | 780 | 30 | 33 | 0.73 | 100 |
| I14 | E | 10 | 720 | 90 | 92 | 0.05 | 3 |
| R12 | F | 30 | 780 | 90 | 93 | 0.93 | 100 |

TABLE 4

| hardness and microstructure results | | | | | |
|---|---|---|---|---|---|
| Sample Reference | Steel composition | Hvini (Vickers) | % recrystallised ferrite | % martensite + bainite + carbides | % non recristallysed |
| I1 | A | 197 | 77% | 23% | 0% |
| I2 | A | 220 | 68% | 32% | 0% |
| R1 | A | 313 | 34% | 66% | 0% |
| R2 | A | 354 | 56% | 31% | 13% |
| I3 | A | 190 | 77% | 23% | 0% |
| I4 | B | 238 | 73% | 27% | 0% |
| I5 | B | 250 | 75% | 25% | 0% |
| R3 | B | 335 | 47% | 53% | 0% |
| R4 | B | 345 | 36% | 64% | 0% |
| R5 | B | 304 | 49% | 51% | 0% |
| I6 | C | 232 | 87% | 13% | 0% |
| I7 | C | 252 | 67% | 33% | 0% |
| R6 | C | 465 | 41% | 59% | 0% |
| R7 | C | 366 | 42% | 58% | 0% |
| I8 | C | 206 | 71% | 29% | 0% |
| I9 | D | 239 | 67% | 33% | 0% |

TABLE 4-continued

| hardness and microstructure results | | | | | |
|---|---|---|---|---|---|
| Sample Reference | Steel composition | Hvini (Vickers) | % recrystallised ferrite | % martensite + bainite + carbides | % non recristallysed |
| I10 | D | 262 | 61% | 39% | 0% |
| R8 | D | 354 | 54% | 46% | 0% |
| R9 | D | 367 | 34% | 66% | 0% |
| I11 | D | 266 | 61% | 39% | 0% |
| I12 | E | 207 | >84% | 11% | <5% |
| I13 | E | 215 | 87% | 13% | 0% |
| R10 | E | 426 | 58% | 42% | 0% |
| R11 | E | 492 | 36% | 64% | 0% |
| I14 | E | 203 | 84% | 16% | 0% |
| R12 | F | 470 | 4% | 96% | 0% |

Table 3 lists the process parameters that were used during the annealing step. These parameters were varied to produce examples within the inventive production process and outside of the invention.

Table 4 lists the results of the hardness test and the microstructure analysis of each sample.

In tables 3 and 4, the references of the examples within the invention start with an I (for invention) and the counter-examples start with an R (for reference).

Referring to table 3, all the examples within the invention have a K factor strictly below 0.50. On the other hand, the reference examples all have annealing process parameters, which once compounded through the K factor formula, result in a K factor equal to or above 0.50.

Referring to table 4, thanks to the specific set of process parameters of the inventive examples leading to a K factor below 0.50, all the examples within the invention present a steel hardness before hot stamping (Hvini), which is below 270 Hv. This allows to easily process said steel sheets before hot forming, for example to mechanically cut said steel sheets without damaging the cutting tools or to wind and unwind them in the form of a coil etc.

Referring to table 4, all the samples according to the invention have a microstructure before hot stamping comprising, in surface fraction, from 60% to 100% of recrystallized ferrite, less than 40% of the sum of martensite, bainite and carbides and less than 5% of non-recrystallized ferrite. This specific microstructure, comprising a high amount of ferrite, which is soft, and limiting the amount of hard phases (martensite, bainite, carbides and non-recrystallized ferrite), allows to limit the hardness of the steel sheet below 270 Hv.

On the other hand, reference samples for which the annealing process parameters are such that the K factor is above or equal to 0.50 all exhibit a steel sheet hardness Hvini above 270 Hv. Their microstructure comprises less than 60% of recrystallized ferrite. Furthermore, either the amount of non-recrystallized ferrite is above 5% (sample R2) or the sum of the surface fractions of martensite, bainite and carbides is above 40% (all other reference samples).

Due to their very high hardness before hot stamping, said reference samples will be difficult to process before hot stamping, which will generate production issues at the facility of the manufacturer of the steel sheet itself (difficulties to guide the material on the production line, to wind it in coil form, to cut at the exit of the line, etc) and at the facility of the hot stamper and intermediates (difficulty to cut in blanks, punch holes etc).

Furthermore, it should be noted that the above described properties and results are obtained for a wide range of cooling rates after the annealing furnace. Indeed, the cooling rates of table 3 range from 3° C./s to 100° C./s. This means that the annealing process according to the invention is robust, whatever the subsequent cooling rate on the line where annealing is performed. There is no need for a specific control of the cooling rate, for example using an over-ageing section in the cooling section after annealing. This is very interesting for the steel sheet manufacturer, who will not need to put in specific cooling rate control measures after the annealing furnace.

TABLE 5

| quenching trials | | | | | | | | | | |
|---|---|---|---|---|---|---|---|---|---|---|
| | | | | high quenching rate | | | slow quenching rate | | | |
| | | | | | | | | Hvslow: | | |
| Steel | Austenitizing Temperature (° C.) | Heating rate (° C./s) | Total dwell time (sec) | High quenching rate (° C./s) | Hvfast: hardness after high quenching rate (Hv) | Microstructure after high quenching rate | Slow quenching rate (° C./s) | Hv after quenching at slow quenching rates (Hv) | Microstructure after slow quenching rate | Hvfast − Hvslow (Hv) |
| A | 900 | 10 | 387 | 465 | 465 | >95% martensite | −15 | 459 | >95% martensite | 6 |
| B | 900 | 10 | 387 | 481 | 463 | >95% martensite | −15 | 445 | >95% martensite | 18 |
| C | 900 | 10 | 387 | 534 | 513 | >95% martensite | −10 | 494 | >95% martensite | 19 |
| D | 900 | 10 | 387 | 533 | 525 | >95% martensite | −5 | 493 | >95% martensite | 32 |
| E | 900 | 10 | 387 | 578 | 578 | >95% martensite | −20 | 573 | >95% martensite | 5 |
| F | 900 | 10 | 387 | 485 | 485 | >95% martensite | −20 | 358 | 30% ferrite + 40% bainite + 30% martensite | 127 |

Table 5 shows the results of tests with high and low quenching speeds on steels A-F The samples of table 5 were submitted to 2 different hot stamping process thermal path for each chemistry using the same set of parameters in the austenitizing furnace and two different set of quenching parameters. The samples produced using a high quenching rate were quenched at 100° C./s after exiting the austenitizing furnace. The samples produced using a low quenching rate were quenched at rates ranging from 5° C./s to 20° C./s after exiting the austenitizing furnace according to the sample. All samples were heated in the same way at 900° C. and held at that temperature for a dwell time of 387 seconds.

The microstructure of the thus produced samples and their hardness are reported in table 5.

In all cases, when using high quenching rates, the ensuing hot stamped part has a microstructure comprising more than 95% martensite and a hardness above 440 Hv, which converts to a tensile strength approximately above 1400 MPa.

On the other hand, when using a slow cooling rate, the hot stamped part produced using steel F, which has a Q factor of 27, has a microstructure comprising only 30% martensite and large portions of the softer phases ferrite (30%) and bainite (40%). As a consequence, the hardness of the thus produced hot stamped part is much lower and there is a significant gap of 127 Hv between the hardness of the high quenching rate part and the low quenching rate part.

However, steel compositions A-E, which all have a Q factor below 20, even more preferably below 16, lead to hot stamped parts having more than 95% martensite even at low quenching rates, equal to or lower than 20° C./s. This is thanks to their low Q factor which allows them to be much less sensitive to the quenching speed. As a consequence, the hardness of the hot stamped parts at low quenching rates produced with steels A-E remains above 440 Hv and the hardness gap between the high and low quenching rate parts remains very low, less than or equal to 40 Hv.

This means that steel compositions A-E are suitable for use in a hot stamping process having a low cooling rate, for example below 20° C./s. For example, these steel compositions are suitable for use in a multistep hot stamping process.

In conclusion, samples manufactured with steels A-E and using annealing process parameters such that the K factor is kept lower than 0.50 are both suitable for use in a hot stamping process involving low quenching speeds, for example below 20° C./s or even 16° C./s, while being sufficiently soft before hot stamping to be easily processed by cutting or preforming for example.

What is claimed is:

1. A process to manufacture a steel sheet having the following chemical composition comprising, by weight percent:

C: 0.26-0.40%
Mn: 0.5-1.8%
Si: 0.1-1.25%
Cr 0.1-1.0%
Al 0.001-0.1%
Ti 0.01-0.1%
B 0.001-0.004%
P≤0.020%
S≤0.010%
N≤0.010% and one or more of the following optional elements:

Ni≤0.5%
Mo≤0.40%
Nb≤0.08%
Ca≤0.1% a remainder of the composition being iron and unavoidable impurities resulting from processing, the impurities reaching up to the following levels, according to the process employed:

Sb≤0.03%
As≤0.03%
Pb≤0.03%
Sn≤0.010% wherein Q is less than 20, Q being defined as:

Q=114−68*C−18*Mn+20*Si−56*Cr−61*Ni−37*Al+39*Mo+79*Nb−17691*B, wherein all elements are expressed in weight percent, the process comprising the steps of:

reheating a cast slab having the composition to a temperature $T_{reheat}$ from 1100° C. to 1300° C. before being hot rolled at a finishing hot rolling temperature between 800° C. and 950° C. to obtain a hot rolled steel sheet;

cooling and coiling the hot rolled steel sheet at a temperature Tcoil lower than 670° C. and optionally pickling said hot rolled steel sheet;

cold rolling the hot rolled steel sheet to obtain a cold rolled steel sheet, applying a reduction ratio ranging from 20% to 80%;

annealing the cold rolled steel sheet using the following annealing line process parameters:

−K<0.50 wherein K is defined by

If the steel composition is such that Mn−Si in weight %>1.5 weight %:

$$K = \frac{Tsoaking - Ae1}{Ae3 - Ae1} * \frac{\ln(trex)}{5} * (1 + 0.1 * \ln(\text{heating rate})) - \left(\frac{Mn}{0.6} - \frac{Si}{1.2}\right) * 0.03$$

If the steel composition is such that Mn−Si≤1.5 weight %:

$$K = \frac{Tsoaking - Ae1}{Ae3 - Ae1} * \frac{\ln(trex)}{5} * (1 + 0.1 * \ln(\text{heating rate}))$$

And wherein:

Tsoaking is the soaking temperature expressed in ° C., and a maximum temperature reached by the steel sheet during the annealing process;

trex is the recrystallisation time expressed in seconds, defined as being the time spent above 700° C. during the annealing process;

heating rate is the speed at which the steel sheet reaches the soaking temperature expressed in ° C./s, so that heating rate=(Tsoaking−30)/(time spent between 30° C. and T soaking Ae1=734+77*C−29*Mn+14*Si+7*Cr−38*Ni−22*Al−25*Mo+123*Nb−8621*B, wherein all elements are expressed in wt %

Ae3=935−257*C−25*Mn+32*Si−17*Cr−83*Ni+17*Al+129*Mo+156*Nb−19473*B, wherein all elements are expressed in wt %.

2. The process as recited in claim 1 wherein the pickling of the hot rolled steel sheet is performed and the cold rolling is performed on the pickled hot rolled steel sheet.

3. A process to manufacture a hot stamped part comprising the following steps:

providing a blank manufactured from a steel sheet manufactured according to claim 1;

heating the blank to an austenitizing temperature above Ac1; and transferring the blank to a hot stamping tool and simultaneously forming and quenching the steel sheet at a quenching rate less than or equal to 20° C./s and greater than or equal to 5° C./s, wherein the quenching rate= (austenitizing temperature−300° C.)/(time spent by the steel blank between the exit of the austenitizing furnace and reaching 300° C.).

4. The process as recited in claim 3 wherein the hot stamping process is a multistep process.

* * * * *